United States Patent [19]

Funke

[11] Patent Number: 4,497,310

[45] Date of Patent: Feb. 5, 1985

[54] FLUE BOX WITH ADJUSTABLE COUNTERBALANCE CAP

[75] Inventor: Craig D. Funke, Chicago, Ill.

[73] Assignee: NRG Systems, Inc., Chicago, Ill.

[21] Appl. No.: 579,259

[22] Filed: Feb. 13, 1984

[51] Int. Cl.[3] ..... F23L 3/00

[52] U.S. Cl. ..... 126/292; 126/312; 126/285 R; 98/59

[58] Field of Search ..... 126/307 R, 292, 285 R, 126/312, 293; 236/45, 49; 98/59, 60; 292/87

[56] References Cited

U.S. PATENT DOCUMENTS

| | | | |
|---|---|---|---|
| 1,263,830 | 4/1918 | Wolf | 236/45 |
| 2,005,981 | 6/1935 | Morrow | 236/45 |
| 2,539,789 | 1/1951 | McCorkle | 236/45 |
| 3,407,720 | 10/1968 | Westerman | 98/59 |
| 4,136,676 | 1/1979 | McCown | 126/292 |

*Primary Examiner*—James C. Yeung

*Attorney, Agent, or Firm*—Basil E. Demeur

[57] ABSTRACT

There is disclosed an improved flue box assembly for use in conjunction with a heating plant, the flue box having a housing with an interior diametric opening substantially greater than the exhaust gas inlet to and outlet from the interior of the housing, and provided with a damper plate being pivotally mounted within the housing and movable between an open position and a closed position, the damper plate further having a flue opening positioned therein, the improvement consisting of a cap pivotally mounted on the housing adjacent the outlet opening thereof, the cap adapted to pivotally move between a closed position occluding the outlet opening of the housing and an open position leaving the outlet opening unobstructed, and adjustable counterbalancing means associated with the cap for adjusting the relative pressure necessary to move the cap into an open and closed position respectively in relation to the force exerted by flue gases escaping through the outlet opening of the housing, thus providing for improved heat transfer and restoration of proper combustion zone balance in the appliance.

3 Claims, 2 Drawing Figures

FLUE BOX WITH ADJUSTABLE COUNTERBALANCE CAP

BACKGROUND OF THE INVENTION

The present invention pertains to a flue box assembly for use in conjunction with heating plants which is designed to insure the complete combustion of the fuels in a heating plant for energy conservation purposes, and improved heat transfer to optimize energy conservation.

Heretofore, flue box assemblies have been developed for installation along the outlet exhaust pipes emanating from a heating plant, the flue box being designed to insure the complete combustion of the fuels utilized in connection with a heating plant. It has been known, for example, that in a typical heating plant, a certain percentage of the fuels provided to the heating plant will remain unburned and will escape from the heating plant along with the flue gases representing the products of combustion of that portion of the fuel which has in fact been combusted. In addition, the heat transfer process is substantially reduced, thereby creating an improper balance in the combustion zone. In general, flue boxes of this nature have heretofore been developed as shown by U.S. Pat. No. 4,372,289 as well as U.S. Pat. No. 4,136,676. As is clearly described therein, the flue box is designed with a pivotally movable damper plate located within the interior portion of the housing of the flue box assembly, the damper plate being movable between an open and closed position. Under normal conditions, the damper plate will stay substantially closed, and will block the flow path of the flue gases being exhausted from the heating plant. Since these flue gases contain unburned fuels as well, the gases are restrained in the heating plant such that a more complete combustion of the fuels will be achieved, and better heat transfer attained. Furthermore, by having the damper plate pivotally movable therein, under conditions of extreme back pressure or explosion, the damper plate is designed to pivotally move to a complete open position thereby to provide an immediate exit path for the flue gases emanating from the heating plant.

Further improvements have been achieved by creating the flue box assembly having a greater diametric opening than either the inlet or outlet openings therefrom. Hence, it has been found that by providing an expanded chamber for the flue gases to enter the flue box from the heating plant, stratification of the denser unburned fuel products near the surfaces of the flue box and the exhaust conduit will occur. As hot exhaust gases are produced, a channeling effect occurs wherein a central column of hotter gas is created which may cause a build-up of the unburned fuel vapors below the damper plate in the flue box assembly. Hence, further efficiencies in connection with energy conservation can be effected where the damper plate is provided with one or more flue openings or apertures positioned therein thereby avoiding or minimizing the danger of back pressure of the unburned gases or other gases caused by stratification under the damper plate.

It has further been observed that in some installations, it is necessary to provide the flue box with an additional device in order to insure that the unburned fuels will in fact be forced back into the furnace for total combustion. In this connection, it has now been found that by providing the flue box with a pivotal cap, which is designed to move between an open and a closed position thereby either occluding, or rendering the outlet opening from the flue box unobstructed, further efficiency of fuel combustion is achieved, including an increased efficiency in heat transfer and the restoration of proper combustion zone balance. This is especially true when the pivotal cap is provided on a flue box of the type having a pivotal damper plate mounted therein. However, in order to provide a cap for a flue box assembly, it is again necessary that the cap not only be pivotally adjustable, thereby to move between an unobstructed open position, and an occluded closed position relative to the flue box, but that the cap must be designed to achieve a delicate counterbalancing relationship with respect to the pressure of the flue gases exiting from the furnace via the flue box assembly.

OBJECT AND ADVANTAGES

It is therefore the principal object of the present invention to provide an improved flue box assembly which further includes a cap pivotally mounted to the housing adjacent the outlet opening thereof which is designed to pivot between an open unobstructed position, and a closed occluded position relative to the housing.

In conjunction with the foregoing object, it is a further object of the present invention to provide an improved flue box assembly of the type having a pivotally movable cap wherein the cap includes an adjustable counterbalancing means associated with the cap which permits the adjusting of the relative pressure necessary to move the cap into an open and closed position respectively in relation to the force exerted by flue gases escaping through the outlet opening.

Further in conjunction with the above objects, the present invention provides a flue box assembly including a pivotally mounted cap with a counterbalancing means of the type described wherein the counterbalancing means includes a weight movably positioned such that the weight may be moved toward and away from the cap thereby to adjust the relative pressure exerted by the cap in relation to the fluid pressure exerted by the effluent gases exiting from the outlet opening of the housing, thereby to render said cap fully adjustable with respect to the gas pressures realized from the effluent gases, and maintain proper combustion zone balance.

Further features of the invention pertain to the particular arrangement of the elements and parts whereby the above-outlined and additional operating features thereof are attained.

The invention, both as to its organization and method of operation, together with further objects and advantages thereof, will best be understood by reference to the following specification, taken in conjunction with the accompanying drawings.

BRIEF SUMMARY OF THE INVENTION

In summary, the present invention provides an improved flue box assembly which includes a cap pivotally secured to the outlet opening of the housing of the flue box, and having a counterbalancing and adjustable weight associated with the cap such that the relative ease or difficulty of the cap opening in response to the fluid pressure of the gases exiting from the housing outlet may be adjusted in order to insure that unburned gases will remain in the system and be fully burned before exiting therefrom. In addition, as a direct result of improved pressure balance the heat transfer process will be enhanced. The housing may further be provided with an adjustable stop such that the degree of the opening of the cap relative to the housing may similarly be limited to any desired maximum capacity despite the location of the adjustable weight relative to the cap. These features, when designed in combination with the housing having a damper plate pivotally mounted therein, especially where the damper plate also is provided with flue openings, has a tendency to render the flue box assembly more efficient in terms of insuring that unburned gases will be retained in the system and burned fully before the gases are allowed to escape from the closed system.

DETAILED DESCRIPTION OF DRAWINGS

Figure 1:
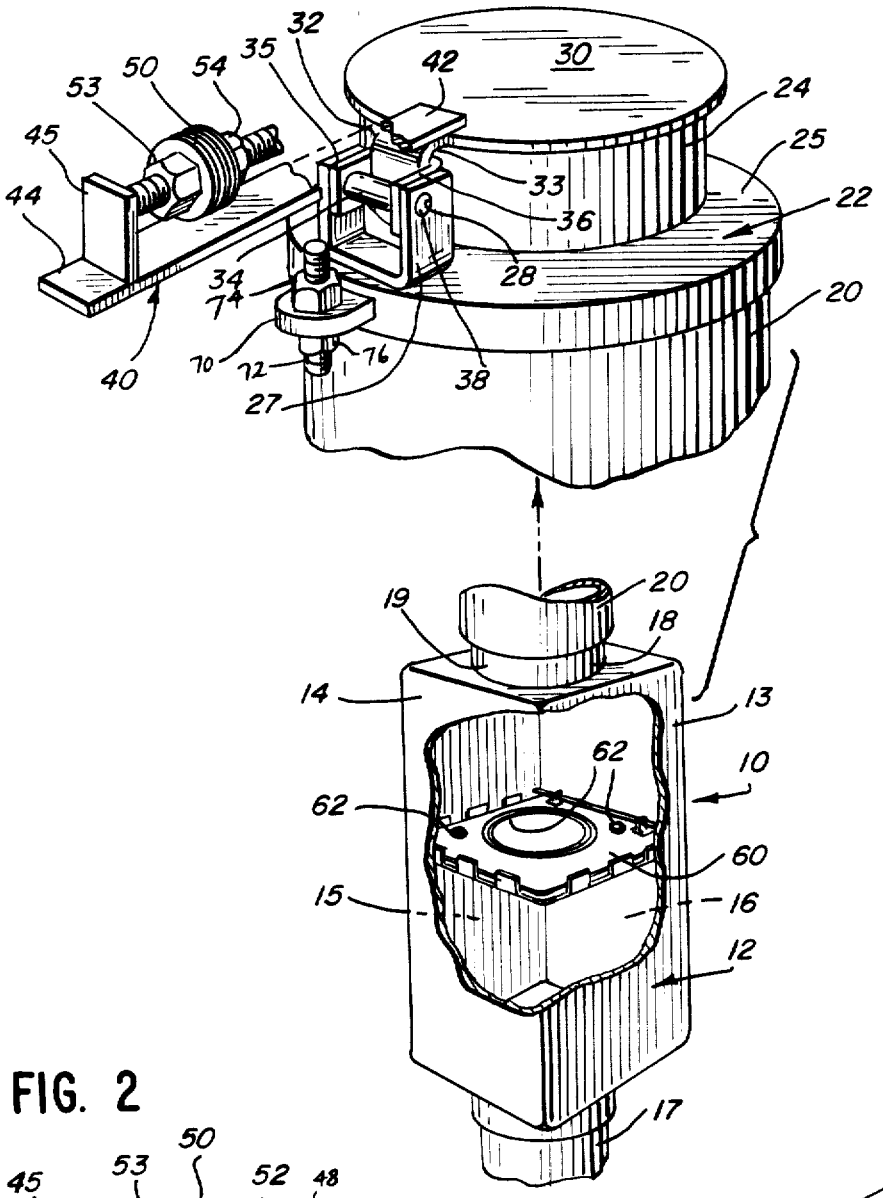
FIG. 1 is a perspective view showing a typical flue box assembly of the type having a pivotally movable damper plate positioned therein, and having the outlet opening portion thereof shown in an exploded view illustrating a cap pivotally secured to the housing, and having adjustable counterbalancing weights associated therewith.

As shown in FIG. 1, the flue box assembly 10 is generally shown. The flue box assembly 10 is shown to be formed by housing 12 which is enclosed on all four sides by side walls 13, 14, 15 and 16 respectively. The housing 12 includes a gas inlet aperture (not shown), which is connected to the exit pipe 17 emanating from the heating plant or other furnace device (not shown). At the opposed end of the housing 12 is a gas outlet aperture 18 which is fitted with an outlet collar 19 to which is attached the outlet pipe 20.

As was previously indicated, a flue box assembly of the type shown is more clearly described in U.S. Pat. No. 4,136,676 as well as U.S. Pat. No. 4,372,289 wherein the precise details of construction of such a device, and the manner in which it interconnects with an existing heating plant or furnace is set forth. The improvement forming the present invention consists in the provision of a pivotally movable cap having adjustable counterbalancing means as more fully set forth hereinafter.

The gas outlet pipe 20 is shown to be provided with a closed top member 22 having an exit collar 24 centrally positioned thereon. As is more fully shown in FIG. 2 of the drawings, the exit collar 24 has an open top end as generally indicated by the numeral 26, which is opened and closed by the cap 30. The top member 22 is shown to include a circumferential flat surface 25 which provides a mounting surface for a U-shaped bracket 27 which is, in turn, provided with a pair of opposed mounting apertures 28.

The cap 30 is shown to be provided with an L-shaped pivot bracket 32 which is fixedly secured at its forward end 33 to the cap 30 and includes a mounting collar 34 at its opposed end. The L-shaped pivot bracket 32 and the mounting collar 34 forming a part thereof are in turn fixedly secured to and unitary with opposed side mount brackets 35 and 36 respectively. It will be appreciated from a view of FIG. 1 of the drawings that the L-shaped pivot bracket 32 including the mounting collar 34 and the side mount brackets 35 and 36, respectively are pivotally mounted to the U-shaped bracket 27 carried on the circumferential flat surface 25 of the top member 22 by means of a pivot pin 38 which is mounted through the internal confines of the mounting collar 34 and appropriate apertures provided in the side mount brackets 35 and 36 respectively, and journaled in the mounting apertures 28 carried in the U-shaped bracket 27.

The cap 30 is further provided with a holding bar 40 which is mounted at its forward end 42 to the cap 30, and extends radially outwardly therefrom. As depicted in FIG. 1 of the drawings, the holding bar 40 is shown to be a flat bar having an upper mounting surface 44 which carries a pair of opposed upright brackets 45 and 46 respectively (see FIG. 2). A threaded round bar 48 is shown to be carried between the opposed upright brackets 45 and 46 respectively, the threaded round bar 48 being fixedly secured to the upright brackets 45 and 46 at the opposed ends thereof.

A weight 50 is shown to be carried on the threaded round bar 48 and movable along the length thereof, by being provided with a central aperture 52 (FIG. 2), the weight 50 being held in position by a pair of opposed threaded nuts 53 and 54 respectively. As viewed in FIG. 2 of the drawings, in phantom, the weight 50 may be moved forwardly or rearwardly along the length of the threaded round bar 48 merely be screwing and unscrewing the threaded nuts 53 and 54 respectively such that the weight 50 may be positioned at any point along the length of the bar 48.

Figure 2:
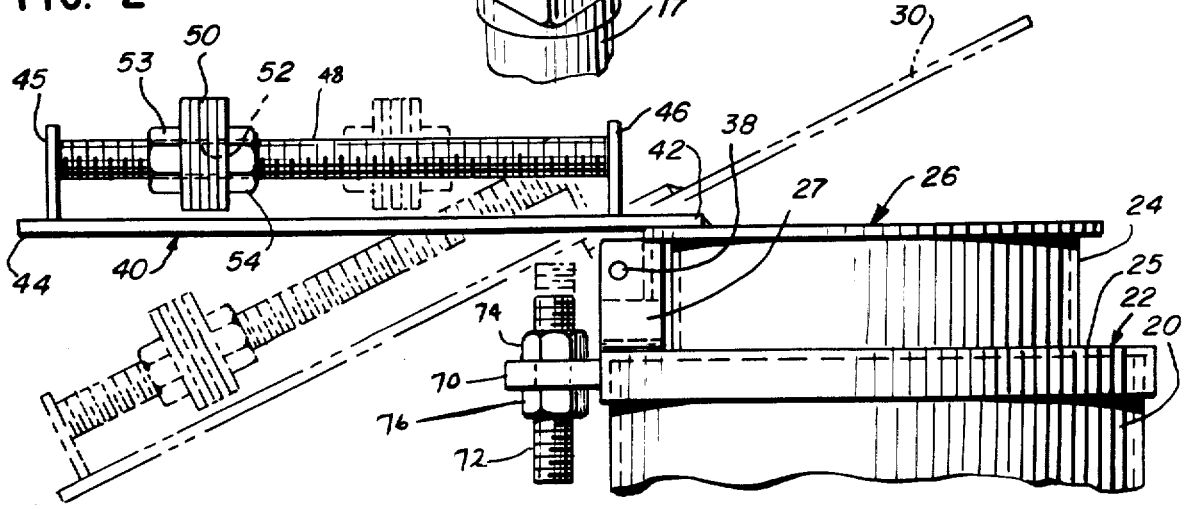
FIG. 2 is a side elevational view, partly broken away, and in cross section, illustrating the pivotal movement of the cap relative to the housing outlet, and the manner in which the counterbalancing weight may be movably adjusted with respect to the cap.

It will be appreciated from a view of FIG. 2 of the drawings, that where the weight 50 is positioned adjacent the outward end 43 of of the holding bar 40, that the cap 30 will be counterbalanced to a point such that it takes a relatively small amount of pressure against the undersurface of the cap 30 to open the same to permit the release of flue gases through the opening in the top member 22. On the other hand, where the weight 50 is screw threadedly moved to a point closer the cap 30, the weight consideration associated with the cap 30 are such that it will take a relatively greater amount of flue gas pressure against the undersurface of the cap 30 to open the same and permit the release of flue gases.

It will therefore be appreciated that where the flue box assembly 10 further includes a damper plate 60 which is provided with venting apertures 62, it will be appreciated that the venting apertures 62 in combination with the pivotal damper plate 60 control the movement of the flue gases through the flue box assembly 10. By providing the cap 30 with a counterbalancing weight 50 which is adjustable such that relative pressure necessary to open the cap 30 may be adjusted and tuned, relative to the flue gas pressures which operate against the damper plate 60, a fine balance may be achieved as between the cap 30, and the operation of the damper plate 60 within the flue box assembly 10. In this manner, one is able to achieve a very fine control over the dwell time of the flue gases within the system thereby to insure that all or susbstantially all of the unburned fuels will be burned prior to exiting from the system.

Furthermore, it will also be appreciated that the cap 30 and the counterbalancing weight 50 may be positioned at the top end of the stack emanating from the flue box assembly 10 at a point removed therefrom such that the cap 30 and the counterbalancing weight 50 may be positioned at a point removed from the furnace or other heating plant, and externally of the corresponding building in which the heating plant or furnace is located. In that even, it becomes even more clear that the ability to adjust the counterbalancing weight 50 relative to the cap 30 and the pressures of flue gases against the undersurface of the cap 30 are important since as the gases pass up the chimney or stack there might be a loss of velocity because there is a loss of heat as the gases travel therethrough. By being able to counterbalance the cap 30 relative to the pressure necessary to open the same, the same fine degree of control may be obtained regardless of the positioning of the cap 30 and the counterbalancing weight 50.

It is contemplated that by providing a counterbalance adjustable weight in combination with a closure cap relative to a flue box assembly of the type described, a more efficient system may be obtained wherein unburned fuels may be fully combusted prior to exiting from the system, thereby achieving a greater degree of energy conservation.

As shown in FIGS. 1 and 2 of the drawings, and in the preferred embodiment of the adjustable counterbalance to the cap 30, it will be observed that the top member 22 of the outlet pipe 20 is provided with an ear 70 fixedly secured thereto and extending laterally outwardly therefrom. The ear 70 includes a central aperture (not shown), which accommodates a threaded stop 72 therethrough. The threaded stop 72 is held in position by a pair of opposed threaded nuts 74 and 76 respectively, such that the threaded stop 72 may be adjusted along its vertical axis. It will be appreciated from a view of FIG. 2 of the drawings, that the threaded stop 72 functions to limit the degree of opening of the cap 30, thereby to further enhance the heat conservation characteristics of the device by permitting the cap 30 to open to a very extended position, or, to be limited to a very small degree of opening, as is illustrated by the phantom lines in FIG. 2 of the drawings.

While there has been described what is at present considered to be the preferred embodiments of the invention, it will be understood the various modifications may be made therein and it is intended to cover in the appended claims all such modifications as fall within the true spirit and scope of the invention.

I claim:

1. A flue box assembly of the type for use in conjunction with a heating plant having a housing with an interior diametric opening substantially greater than the exhaust gas inlet to and outlet from the interior of the housing, the housing having an inlet opening for flue gases to enter the housing and an outlet opening for flue gases under pressure to exit from the housing, and the housing including damper means pivotally mounted therein to permit movement between an open position and a closed position, the damper means further having a flue opening positioned therein, the flue opening being diametrically smaller than either the inlet or the outlet openings of the housing, the improvemnt comprising in combination, a cap pivotally mounted on said housing adjacent the outlet opening thereof, said cap adapted to pivotally move between a closed position occluding the outlet opening of the housing and an open position whereby the outlet opening is unobstructed, said cap further including a holding bar mounted on said cap in juxtaposition with respect to the pivotal mounting point of said cap and extending radially outwardly therefrom, and adjustable counterbalancing means associated with said cap for adjusting the relative pressure necessary to move said cap into an open and closed position respectively in relation to the force exerted by flue gases escaping through said outlet opening, said counterbalancing means comprising a threaded rod associated with and extending radially outwardly from a pivotal mounting point of said cap, said threaded rod including a threaded weight, threadedly carried thereon thereby to be threadedly movable along the length of said rod such that said weight may be moved toward and away from said cap thereby to adjust the relative pressure necessary to move said cap into an open and closed position respectively, said threaded rod being mounted on and carried by said holding bar having said threaded weight threadedly secured thereon for movement along the length of said threaded rod, whereby said cap is adapted to pivotally move to an open position in response to pressure exerted thereagainst by the flue gases exiting through the housing outlet opening, said counterbalancing means permitting the adjustment of the pressure exerted by said cap against the flow of flue gases thereby to adjust the degree by which said cap will open.

2. The improved flue box assembly as set forth in claim 1 above, which further includes stop means mounted on said housing and positioned below said holding bar for limiting the movement of said cap into the open position.

3. The immproved flue box assembly as set forth in claim 2 above, wherein said stop means is formed by an ear fixedly secured to said housing and extending radially outwardly therefrom for a short distance, said ear having a threaded aperture positioned therein, and a threaded rod threadedly mounted within said threaded aperture thereby to be threadedly movable along an axis transverse to the axis of said ear such that said threaded bar may be moved upwardly and downwardly with respect to said ear thereby to adjust the stop point relative to said holding bar.

* * * * *